US007789543B2

(12) United States Patent
Manscher

(10) Patent No.: US 7,789,543 B2
(45) Date of Patent: Sep. 7, 2010

(54) HANDLE FOR LIGHT FIXTURE

(75) Inventor: Peter Manscher, Egaa (DK)

(73) Assignee: Martin Professional A/S, Aarhus N (DK)

( * ) Notice: Subject to any disclaimer, the term of this patent is extended or adjusted under 35 U.S.C. 154(b) by 212 days.

(21) Appl. No.: 12/140,494

(22) Filed: Jun. 17, 2008

(65) Prior Publication Data

US 2009/0310375 A1 Dec. 17, 2009

(51) Int. Cl.
*F21V 21/02* (2006.01)

(52) U.S. Cl. ..... 362/399; 362/272

(58) Field of Classification Search ..... 362/272, 362/285, 287, 399
See application file for complete search history.

(56) References Cited

U.S. PATENT DOCUMENTS

| | | | | |
|---|---|---|---|---|
| 5,490,046 | A * | 2/1996 | Gohl et al. | 362/287 |
| 5,647,661 | A | 7/1997 | Gordin | |
| 5,673,989 | A | 10/1997 | Gohl et al. | |
| 5,800,048 | A | 9/1998 | Gordin | |
| D439,356 | S | 3/2001 | Martinson et al. | |
| 6,220,726 | B1 | 4/2001 | Gordin | |
| 6,932,491 | B2 | 8/2005 | Esakoff | |
| 6,955,447 | B2 | 10/2005 | Lui | |
| D542,450 | S | 5/2007 | Shiu | |
| 2007/0147054 | A1 | 6/2007 | Bornhorst | |
| 2007/0268701 | A1 | 11/2007 | Devlin | |

FOREIGN PATENT DOCUMENTS

| | | | |
|---|---|---|---|
| DE | 202005014393 | U1 | 12/2005 |
| DE | 20 2006 007 227 | U1 | 8/2006 |
| EP | 1 457 735 | A1 | 9/2004 |
| EP | 1 477 730 | A2 | 11/2004 |
| WO | 93/03306 | A1 | 2/1993 |

OTHER PUBLICATIONS

European Search Report For Application No. EP 08 15 8378 dated Nov. 5, 2008.

* cited by examiner

*Primary Examiner*—David V Bruce
(74) *Attorney, Agent, or Firm*—Roberts Mlotkowski Safran & Cole, P.C.; David S. Safran

(57) ABSTRACT

A light fixture having a head, a yoke and a base, the yoke having handles for carrying the light fixture. Placing the handle at the upper part of the yoke is very efficient if the light fixture is to be carried. Access to these handles is possible directly in a flight case because there is sufficient space for getting access to the handles above the yoke. In terms of small light fixtures, an individual can easily carry the light fixture by these handles and safely lift the light fixture from a flight case. In the case of very large light fixtures, two individuals can lift the fixture from both sides of a flight case and can carry the light fixture by the handles. By placing the handles as high as possible in relation to the light fixture, the light fixture can be carried in a very stable manner.

6 Claims, 1 Drawing Sheet

HANDLE FOR LIGHT FIXTURE

BACKGROUND OF THE INVENTION

1. Field of the Invention

The present invention relates to a light fixture comprising a head, which head is rotatable in relation to a yoke by at least a first motor, which yoke is rotatable in relation to a base by at least a second motor, which head comprises at least one light source for generation of a light beam, which base comprises at least a power supply and a controller for control of the light fixture, which yoke comprises handles for carrying the light fixture.

2. Description of Related Art

Carrying a light fixture is an increasing problem when the physical size of light fixtures is increasing. Therefore, handles are placed at the base or at the yoke which is well-known from a number of light fixtures, such as light fixtures from Martin Professional A/S.

If the handle is placed low at the light fixture in relation to the gravitational center, lifting a light fixture from a flight case is difficult because there is a risk of tilting and possibly dropping the light fixture.

Light fixtures comprising handles formed as recesses in the yoke are well-known. These handles are placed below the rotational center of the head and are efficient for small light fixtures that can be carried by an individual. In a situation where a head is not locked or motion damped the head might move during carrying which can lead to movement of the gravitational center of the light fixture which can result in the light fixture being dropped.

SUMMARY OF THE INVENTION

It is the object of the invention to achieve stable carrying handles for light fixtures. A further object of the invention is to place handles for carrying a light fixture at the upper part of the yoke over the gravitational center of the light fixture.

The object of the invention can be fulfilled by a light fixture having a head, which head is rotatable in relation to a yoke by at least a first motor, the yoke being rotatable in relation to a base by at least a second motor, and the head also having at least one light source for generation of a light beam, and in which the base comprises at least a power supply and a controller for controlling the light fixture, by the fixture being modified by providing at least one handle extending from the upper part of the yoke.

Placing the handle at the upper part of the yoke is very efficient if the light fixture is to be carried. Access to these handles is possible directly in a flight case because above the yoke there is sufficient space for getting access to the handle. In terms of small light fixtures, an individual can easily carry the light fixture by these handles and safely lift the light fixture from a flight case. In case of large light fixtures, two individuals can from both sides of a flight case carry the light fixture by the handles. By placing the handles as high as possible in relation to the light fixture, the light fixture can be carried in a very stable manner. Furthermore, in a situation where a light fixture has to be carried from a flight case to the end position where it is to be used, e.g., fastened to a rig which must probably be able to carry several light fixtures, it is important that the transportation of the light fixture can be performed in a way in which no damage to the individuals carrying the light fixture or to the light fixture is inflicted.

The handle can be placed above the rotating center for the head. As a result, it is achieved that if the head starts rotating, this will take place in a position below the handle. In most cases, rotation of the head will not take place as the head is locked when the light fixture is carried. But even in situations where the head has not been locked, carrying the light fixture is possible if the handle is placed above the rotating center.

At the same time, the handle can be placed above the center of gravity of the light fixture. The positioning of the handle above the center of gravity leads to a situation where the light fixture is very stable when it is carried by the handles.

The handle can be placed at the top of the yoke with the handle extending upwards in relation to the head. By letting the handle extend upwardly, it is possible to reach a point of carrying that is somewhat over the top of the yoke. This is positive in achieving a larger distance in relation to the rotating center for the head and also in relation to the center of gravity. In fact, the higher the handles are placed above the yoke, the more efficient the handles will be in use.

Alternatively, the handle can be placed at the top of the yoke extending outwards in relation to the head. Letting the handles extend outwards will provide easy access for a hand into the handle. Increasing the distance between the handles will also increase stability when carrying the light fixture.

Furthermore, the base can comprise at least one handle. Placing additional handles on the base could be very useful if the light fixture is to be carried or placed in operation.

DETAILED DESCRIPTION OF THE INVENTION

Figure 1:
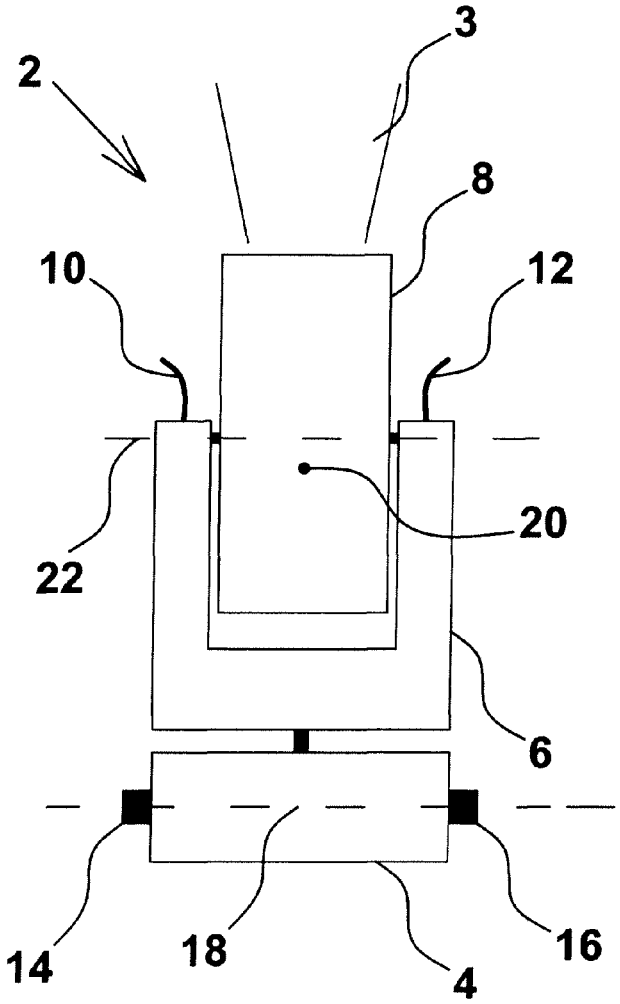
FIG. 1 is a schematic side view of a light fixture.

FIG. 1 shows a schematic side view of a light fixture capable of producing a light beam 3. The light fixture 2 comprises a base 4 and a yoke 6. In the yoke, a head 8 is placed. The yoke 6 comprises handles 10, 12. Furthermore, the base 4 comprises handles 14, 16. The center of gravity 18 for the base is indicated by a line between the handles 14, 16. The center of the head 8 is indicated as the center of gravity 20 and the head can rotate about the axis 22. The head is often constructed such that the center of gravity 20 of the head is positioned near or at the axis of rotation 22.

Figure 2:
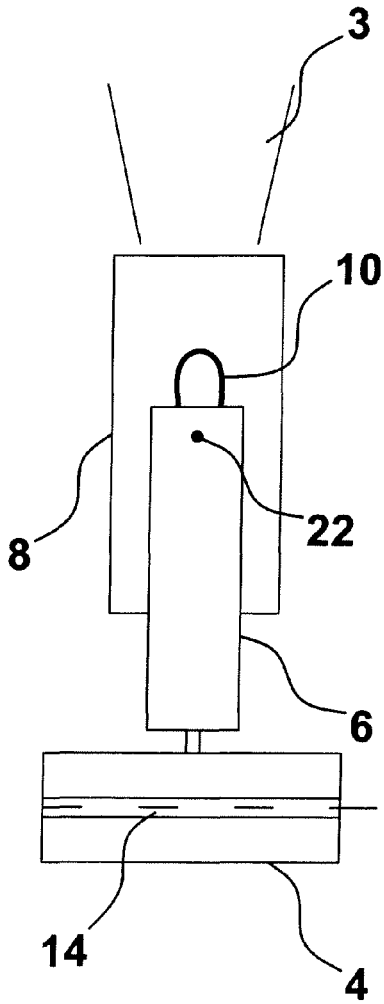
FIG. 2 is a schematic side view of a light fixture at a right angle to the view in FIG. 1.

FIG. 2 is a schematic side view of a light fixture 2. FIG. 2 shows the base 4, the yoke 6 and the head 8. Only one of the handles 10 can be seen.

From FIG. 1, it appears that carrying the light fixture 2 is very efficient if carrying is performed by the handles 10 and 12. These handles 10 and 12 are placed as well above the center of gravity 20 and above the axis of rotational 22 for the head. If the light fixture has to be placed for operation, the handles 14, 16 are very useful as a torque between the handles 10, 14 has a long distance, when both handles are placed outside the center of gravity.

What is claimed is:

1. Light fixture comprising:

a base which comprises at least a power supply and a controller for control of the light fixture, a U-shaped yoke which is rotatable in relation to the base by at least a first motor, a head which is mounted between upstanding legs of the yoke, which is rotatable in relation to the yoke by at least a second motor, and which comprises at least one light source for generation of a light beam, wherein the yoke is provided with handles for carrying the light fixture, at least one handle extending from a top part of the legs of the yoke.

2. Light fixture according to claim 1, wherein the handles are located above an axis of rotation of the head.

3. Light fixture according to claim 1, wherein the handles are located above a center of gravity of the light fixture.

4. Light fixture according to claim 1, wherein the handles are located at the top of the yoke and extend upwards in relation to the head.

5. Light fixture according to claim 4, wherein the handles located at the top of the yoke and extend outward in relation to the head.

6. Light fixture according to claim 1, wherein the base comprises at least one additional handle.

* * * * *